United States Patent [19]

Johnson et al.

[11] Patent Number: 4,638,726

[45] Date of Patent: Jan. 27, 1987

[54] LOAD BEARING SWAB CUP

[75] Inventors: Phil E. Johnson; Robert K. Brock, both of Arlington, Tex.

[73] Assignee: LTV Energy Products Company, Dallas, Tex.

[21] Appl. No.: 721,911

[22] Filed: Apr. 10, 1985

[51] Int. Cl.[4] ..... F16J 9/00

[52] U.S. Cl. ..... 92/241; 277/212 C; 277/235 R; 417/555 A

[58] Field of Search ..... 92/241, 248, 249, 254; 277/212 C, 235 R; 417/555 A

[56] References Cited

U.S. PATENT DOCUMENTS

| | | | |
|---|---|---|---|
| 2,581,981 | 1/1952 | Taylor, Jr. . | |
| 2,862,776 | 12/1958 | Bowerman . | |
| 3,399,605 | 9/1968 | Landers et al. . | |
| 3,417,673 | 12/1968 | Bowerman . | |
| 3,724,337 | 4/1973 | Richardson | 92/241 |
| 3,724,338 | 4/1973 | Richardson | 92/241 |
| 4,254,962 | 3/1981 | Blackwell | 92/241 X |

OTHER PUBLICATIONS

Oil States Industries General Catalog 1984–1985, p. 3.

*Primary Examiner*—Stephen F. Husar
*Attorney, Agent, or Firm*—Arnold, White & Durkee

[57] ABSTRACT

An improved reinforcement cage assembly for use in the manufacture of a load lifting swab cup wherein the swab cup includes an elastomeric material bonded to the reinforcement cage assembly. The reinforcement cage assembly includes a metal base assembly and a plurality of axially disposed reinforcing wire members. In addition, an improved load lifting swab cup is disclosed having as an integral part thereof the improved reinforcement cage assembly.

14 Claims, 10 Drawing Figures

Fig. 1
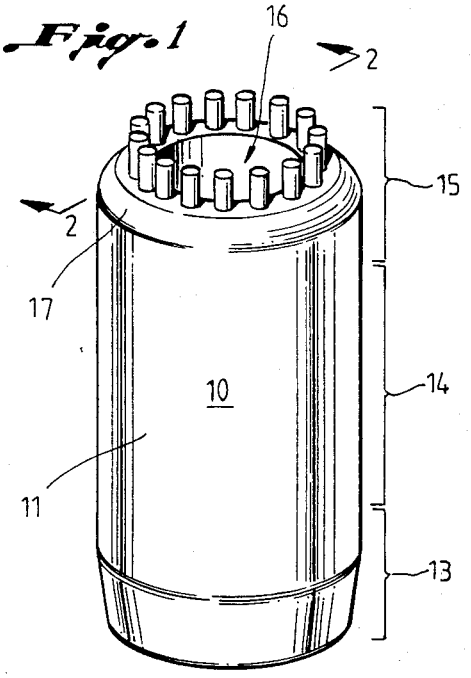
Fig. 2
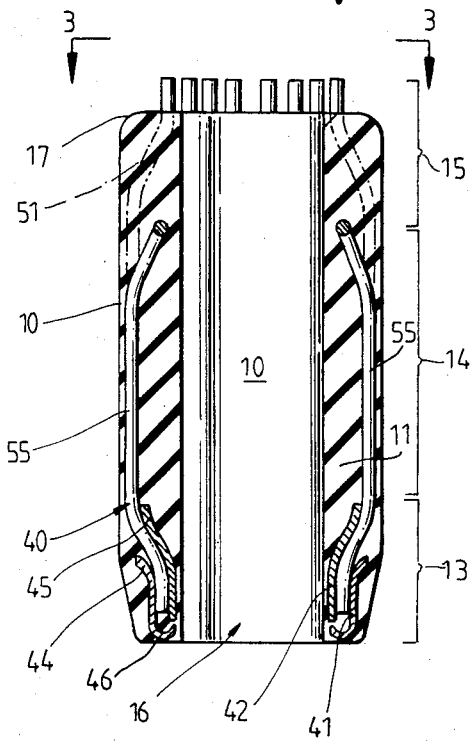
Fig. 3
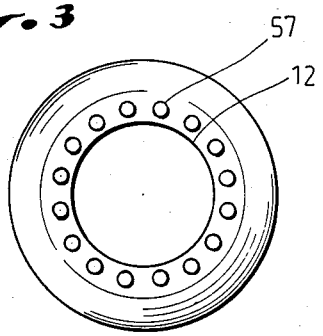
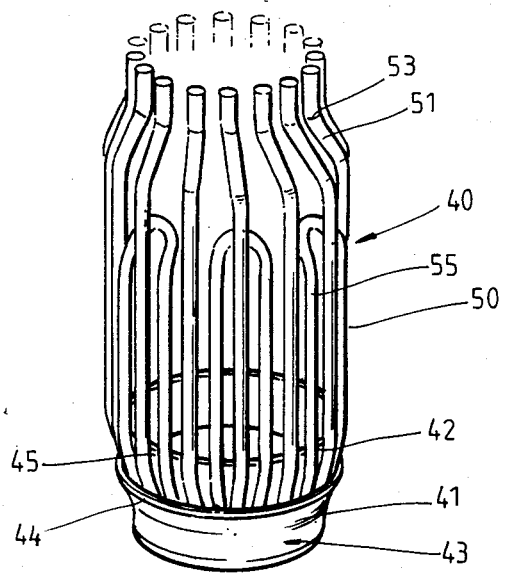
Fig. 4
Fig. 5
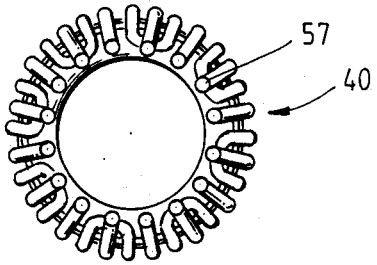

LOAD BEARING SWAB CUP

BACKGROUND ON THE INVENTION

1. Field of the Invention

This invention relates to an improved load lifting swab cup, the reinforcement cage which is used in the manufacture of the improved swab cup and a method for the manufacture of the improved swab cup. Swab cups are categorized as well servicing equipment and can be used for tubing, casing and drill pipe.

2. Description of the Related Art

The primary purpose of a swab cup (sometimes referred to herein as a "cup") is to lift from a well a volume of fluid, such as oil, gas or water, or any other well fluid or debris. Swabbing is described as the operation of a lifting device, i.e. assembly which includes one or more swab cups, to bring well fluids to the surface when the well does not flow naturally. This is a temporary operation to determine whether or not the well can be made to flow. In the event the well does not flow after being swabbed, it is necessary to install artificial lifting devices to bring oil to the surface.

Swabbing and swab cups are used to accomplish a variety of essential functions in the drilling of wells. Typically, swabbing is described as a method of getting the well into production, but it may also be necessary to swab a well many times during its life to keep the tubing clear and to restore production after the well has been worked over. A swabbing operation is often used to clean out the foreign matter in the tubing to assist the well in coming into production. The use of swab cups is well-known in the art.

It has been the usual practice during the manufacture of swab cups of the type with which the present invention is concerned to first assemble a reinforcement cage including a base and reinforcing wires, sometimes using a jig to hold the wires in axially disposed orientation. The assembled reinforcement cage and an uncured elastomeric blank are then placed within a mold which displaces the elastomer around the wires and shapes the cup, some part of the mold frequently holding the wires circumferentially in place during the molding operation. In accordance with the teaching of the prior art, and depending upon the shape of the cup and the mold, the upper ends of the reinforcing wires can be bent inwardly to prevent snagging of the wires during either use before or after the molding operation is completed.

One of the primary difficulties involved in a process of the general type just mentioned resides in the fact that the wire reinforcement cage has a pronounced tendency to disassemble while it is being transferred from the jig in which it is originally assembled to the mold where the rubber is cured around the cage. This tendency makes it awkward to initially assemble the swab cup prior to curing as well as being time consuming from the labor point of view, especially when assembling cups of the type wherein the wires are hooked at their lower ends and are loosely held in holes spaced around the base rings outside surface.

The prior art teaches a number of ways of holding the wires in alignment with the axis of the cup prior to and during introduction of the elastomeric blank into the cage assembly. For example, U.S. Pat. No. 2,581,981 to Taylor teaches the idea of bending the wires double and then supporting them at their lower ends by a captivating and aligning structure which grips the wires tightly while the assembled cage and a rubber blank are being molded and cured. The well swab cup disclosed by Taylor in U.S. Pat. No. 2,581,981 is partially reinforced, however, the upper region is not reinforced so that the flexibility thereof is not impaired. Taylor also discloses the use of a valve assembly to permit travel of the swabbing assembly down through the well fluid as opposed to the modern fluted mandrel.

In addition to problems which are associated with assembling the reinforcement cage, other problems have been noted during use of the swab cups in tubing and casing. In U.S. Pat. No. 2,862,776 to Bowerman the reinforcing elements of the reinforcement cage are captivated at their lower ends in the flange of a metal base in order to secure the lower ends against dislodgement, but the upper ends of the wire elements are allowed radial movement to insure the best possible sealing of the cup against the well pipe and to provide optimum swabbing action, all of which is well-known in the prior art. The Taylor and Bowerman disclosures represent innovative but now technically outdated swab cups. Most modern day swab cups are improvements and modifications to the early swab cups of Taylor and Bowerman.

Furthermore, there has been a long-felt need in the well servicing equipment industry to provide a swab cup which has an improved load carrying capability and an extended life. This need has been previously addressed by the insertion of an additional reinforcing ring into the elastomeric portion of the swab cup just inside the wire reinforcements and just above their lower ends but out of contact therewith. This ring insertion swab cup is the subject matter of U.S. Pat. No. 3,417,673 to Bowerman. The ring is shaped to prevent or limit the downward and outward flow of the elastomer of the swab cup between the reinforcing wires, as occurs when a conventional swab cup is heavily loaded and is "slumping." Such outflow of elastomer leads to pinching of the flowed materials between the swab and the wall of the pipe and to chewing off the pinched material in a manner well-known to those skilled in the art.

Various expedients have been used to try to avoid the loss of elastomer, mostly comprising the use of sleeves of harder material disposed outside and around the lower periphery of the cup. Thus, there has been a long-felt need to reduce the tendency toward mechanical failure of both the elastomer and metal parts which are incorporated into modern swab cups.

Others in the art have addressed the well-known problems, i.e. slumping, rapid wear and ability to adapt to sealing regardless of the load factor, by modifying the reinforcement cage used in the manufacture of swab cups. See for example, U.S. Pat. Nos. 3,724,337 and 3,724,338 to Richardson. The Richardson patents teach a reinforcement cage in which the cage includes inner and outer base rings which cooperate to provide a proper load support for the elastomeric body portion of the cup, while at the same time accurately aligning the lower ends of the wire members. In accordance with Richardson, wires are held tightly between a hardened outer base ring and an inner softer metal ring which has been expanded outwardly toward and against the wires to captivate their lower ends with uniform circumferential spacings while at the same time maintaining the wires in proper axial alignment to facilitate the subsequent assembly of the cage together with an elastomeric blank into a curing mold.

U.S. Pat. Nos. 3,417,673; 3,724,337 and 3,724,338 are commonly assigned. The disclosures of those three patents are hereby incorporated by reference.

The novel and unique reinforcement cage, load lifting swab cup and method for the manufacture thereof as disclosed herein have been designed to specifically address variable pressure requirements, wear characteristics and flexibility requirements of well servicing equipment. The novel, improved swab cup of this invention has been specifically designed with the maximum concentration of reinforcing wires in the area of the cup where "blow-outs" or "slumping" usually occur near the lower region. The concentration of wires molded within the rubber swab cup provides for a minimum gap between wires, the gap being filled by an elastomeric compound. When high internal pressures are encountered during the swabbing operation, the frequency of rubber failures between the wires (in the gaps) increases as the gap width between wires increase. Thus the swab cup of this invention provides for increased pressure readings, which translates into a greater amount of fluid removed from a well per swab run.

The wear resistance characteristic, which has been a constant problem with prior art swab cups, has been addressed by designing the novel swab cup of this invention with a maximum number of wires and also a longer overall length than the swab cups of the prior art. This design provides for maximum resistance to wear as the swab cups are moved up and down steel tubing in the well. This resistance to wear prevents the swab cup from prematurely losing its inherent strength due to loss of wall thickness of rubber and thickness of wires in the crucial "blow-out" area.

The novel, improved swab cup of this invention also has enhanced flexibility. The long and short wire design permits the dense concentration of wires in the lower region of the swab cup, but a lower concentration of wires at the upper end. This design feature allows the cup to be very flexible at the top, providing for a seal against the tubing with comparatively lighter loads of fluid than are usually possible with a heavy-duty wire swab cup such as the subject cup. The additional length of the longer wires, acting independently above the shorter wires facilitates loading the swab cup (sealing against the tubing) and removing lighter loads of fluid.

The combination of enhanced performance characteristics equates to a greater volume of fluid removed per run and also an increased number of runs possible per swab cup. Thus fewer swab cups are required for a given job when compared to existing technology. Furthermore, in the process of manufacturing the swab cups of this invention, as disclosed herein, the wires are molded in a prealigned condition. Such prealignment at the top of the swab cup precludes the requirement of a spacer sleeve to prevent the wires from becoming forced around a portion of the swab mandrel when running down into the tubing. This condition is common among existing swab cups in which the wires are molded straight at the top, at a diameter corresponding to the outside diameter of the cup, and then mechanically crimped inwardly.

SUMMARY OF THE INVENTION

The improved reinforcement cage assembly of this invention has utility in the manufacture of a load-lifting swab cup. The reinforcement cage must be compatible with an elastomeric material. Elastomeric materials which have shown utility in well servicing equipment such as swab cups are resilient polymers characterized by compatibility with oil well fluids. The swab cup which is formed using the reinforcement cage of this invention has an axial bore and is configured to be fittably received by a supporting mandrel.

A metal base assembly is a component part of the reinforcement cage of this invention. The metal base assembly includes both inner and outer ring members which are sized and configured to receive and align reinforcing wires. The inner and outer ring members have concentric mated flanges which are designed to retain and align reinforcing wires.

A plurality of reinforcing wire members are axially disposed about the circumference of the improved swab cup of this invention and at the same time are retained and aligned by the metal base assembly. Typically from 10 to 24 reinforcing wires are retained by the base assembly. However, the number and size of wires is variable depending on the size of the swab cup and intended end use of the swab cup. In the heavy duty swab cups which are characteristic of the reinforcement cage assembly of this invention 0.135" diameter wire is used and from 14 to 18 reinforcing wires are preferred. The size and number of wires may vary according to the application.

In the preferrred embodiment of this invention the reinforcing wires are of two different lengths and configurations. A first portion of the reinforcing wires are axially disposed and extend for substantially the entire axial length of the swab cup and in fact in most instances define the axial length of the swab cup. A second portion of reinforcing wires are shorter than the first portion and extend less than substantially the entire axial length of the swab cup. In practice, it is been found that the second portion of reinforcing wires should extend from 40% to 80% of the total axial length of the swab cup. In the most preferred embodiment the second portion of axially disposed reinforcing wire members are U-shaped so that each end of the wires forming the second portion or shorter reinforcing wire members is engaged by the base assembly.

The reinforcing wires of the first portion are specifically configured to provide a curvilinear section at the bottom for convenient retention and alignment by the base assembly and a curvilinear section at the top to prevent snagging in well casing and tubing. The section inbetween top and bottom curvilinear sections on the long reinforcing wires is a flexible section, sometimes referred to as a flex zone, for providing flexible reinforcement to the sides of the swab cup. The shorter axially disposed reinforcing wire members, whether U-shaped double wire members or single wire members, contain one or two curvilinear sections at the bottom for retention and alignment by the base assembly and a flex zone for providing reinforcement to the sides of the swab cup. The portion of the swab cup defined by the base assembly and first curvilinear sections of the reinforcing wires is referred to as the zone of maximum pressure resistance, the portion of the swab cup defined by the second curvilinear section is referred to as the zone of maximum flexibility and everything inbetween as the flex zone.

The improved load-lifting swab cup of this invention includes an axial bore which permits fluid passage during the downward movement of the swab cup and which is sealed during the upward passage after engagement by the mandrel assembly. The improved swab cup includes the reinforcement cage assembly as described hereinabove in combination with an elastomeric material which encompasses a substantial portion of the reinforcement cage assembly. Molded into the configuration of the reinforcement cage assembly and elastomeric material are means for cooperatively receiving a supporting mandrel.

More particularly, the bottom portion of the swab cup is reinforced to an extent that slumping or other deteriorations of the elastomeric material are prevented or substantially reduced. At the same time the upper end of the swab cup is flexible to provide a tight seal during the actual swabbing action during upward movement of the swab cup. The curvilinear upper sections of the reinforcing wires define the internal circumferential periphery of the axial bore of the swab cup of this invention. Reference should be made to the drawings for an illustration of this configuration.

In the method for manufacturing the improved load-lifting swab cup of this invention the components and elements are assembled such that the improved swab cup is characterized by flexibility at its upper end and reinforcement at its lower end. The assembly process includes preparing a first plurality of substantially linear reinforcing wire pieces. The wire pieces are assembled into a reinforcement cage by adjusting the ends of each piece of reinforcing wire to provide first and second (bottom and top) curvilinear sections the first or bottom sections of which are contoured to be received by the base assembly and specifically the flanges of the base assembly. A second plurality of reinforcing wire pieces are prepared for assembly into the reinforcement cage by adjusting at least one end of each piece and in the case of U-shaped wire pieces both ends to be configured in curvilinear sections to be received by the base assembly.

The reinforcing wires are axially disposed in the base assembly by inserting the curvilinear sections of the reinforcing wires inbetween the flanges of the inner and outer rings. The inner and outer rings are then crimped to fixedly retain and align the reinforcing wires and to form the reinforcing cage. Resilient, elastomeric material which comprises the remainder of the swab cup assembly is then molded and bonded by conventional techniques to form the swab cup of this invention.

Examples of the more important features of this invention have thus been broadly outlined in order that the detailed description which follows may be better understood, and so that the contributions which this invention provides to the art may be better appreciated. There are, of course, additional features of the invention which will be described herein and which will be included within the subject matter of the claims appended hereto.

BRIEF DESCRIPTION OF THE DRAWINGS

FIG. 1 is a perspective view showing a swab cup according to the present invention.

FIG. 2 is a cross sectional view taken along line 2—2 of FIG. 1 and illustrating the swab cup of this invention.

FIG. 3 is a top view taken along line 3—3 of FIG. 2 and illustrating the swab cup of this invention.

FIG. 4 is a perspective view, partly in cross section, illustrating a reinforcement cage according to the present invention.

FIG. 5 is a top view of the reinforcement cage of this invention.

DESCRIPTION OF THE PREFERRED EMBODIMENT

Figure 6:
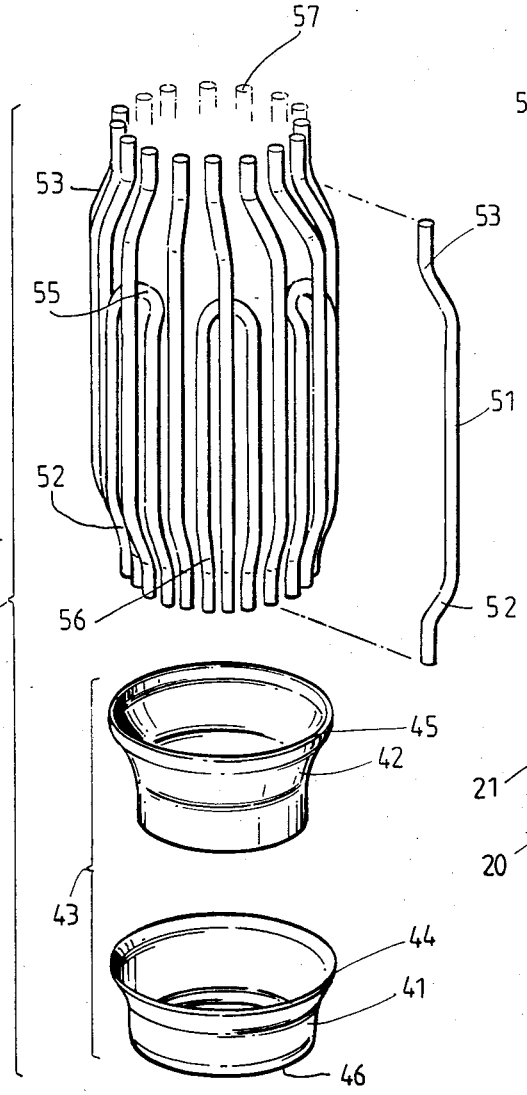
FIG. 6 is an exploded perspective view of the reinforcement cage assembly of this invention.

For purposes of this detailed description like reference numerals indicate similar parts on the drawings associated with this disclosure. Referring now to FIG. 1, a swab cup 10 is illustrated. The essential components of swab cup 10 are reinforcement cage 40 (see FIG. 4), only a portion of which is illustrated in FIG. 1, and a resilient elastomeric body portion 11. The swab cup 10 is specifically designed to provide resilient flexibility so that the cup 10 is able to form a moving fluid seal with the internal surface of well pipe 30 (see FIG. 7), but at the same time the strength to withstand the pressures encountered during use.

The swab cup 10 is characterized by a zone of maximum pressure resistance 13, a zone of flexible reinforcement ("flex zone") 14 and a zone of maximum flexibility 15. Although prior art swab cups have recognized the necessity for zones of varying pressure resistance the improved swab cup of this invention discloses a device that for the first time incorporates the optimum variability of pressure resistance characteristics necessary for full line operation in well servicing equipment. As apparent from FIG. 1, the swab cup 10 is contoured to provide freedom of movement in the well pipe 30. Specifically, the bottom end of cup 10 is tapered to prevent snagging during the downward movement of the cup 10 in preparation for a swabbing run. The upper end is likewise tapered as evidenced by the placement of the exposed tips of reinforcing wires 50 and by the beveled upper surface 17 of elastomeric body 11.

Referring to FIG. 2 the swab cup 10 of this invention is shown in cross section. It is noted that the reinforcement cage 40 extends throughout the entire axial length of the swab cup 10. An axial bore 16 permits the flow of fluid when the swab cup is in its downward travel and retains fluid when the swab cup is being withdrawn from the well tubing or casing during the actual swabbing run.

Figure 7:
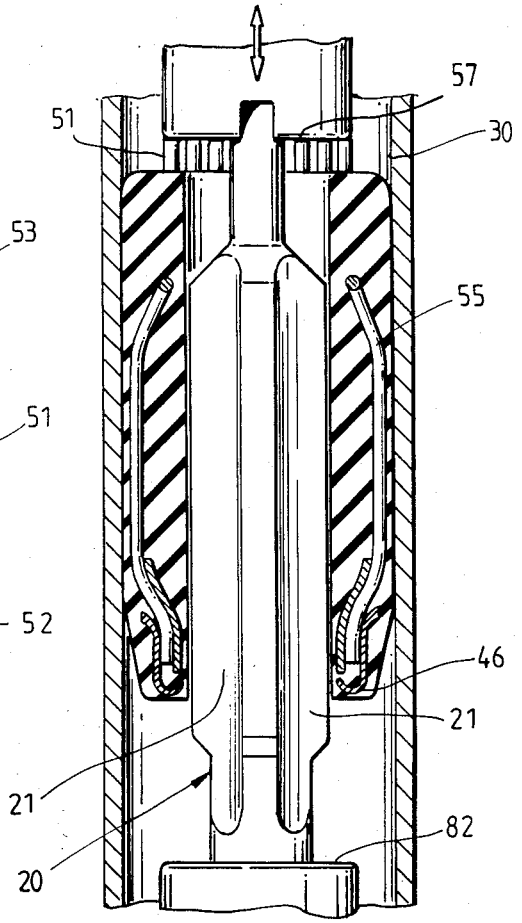
FIG. 7 is a view of the swab cup of this invention associated with a cooperating mandrel assembly and shown within well tubing.
Figure 9:
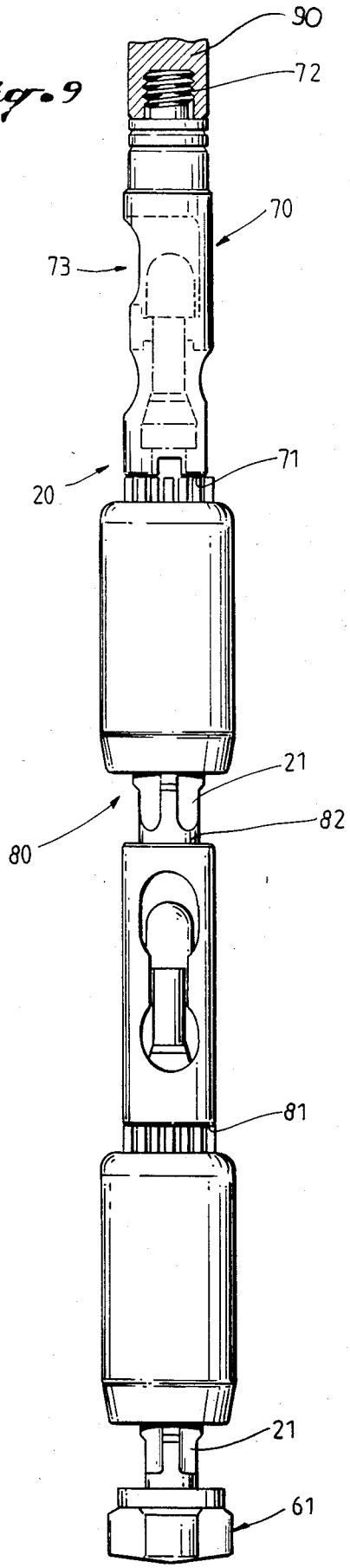
FIG. 9 is a view of the swab cup of this invention associated with a cooperating mandrel assembly as the assembly is descending into the well hole.
Figure 10:
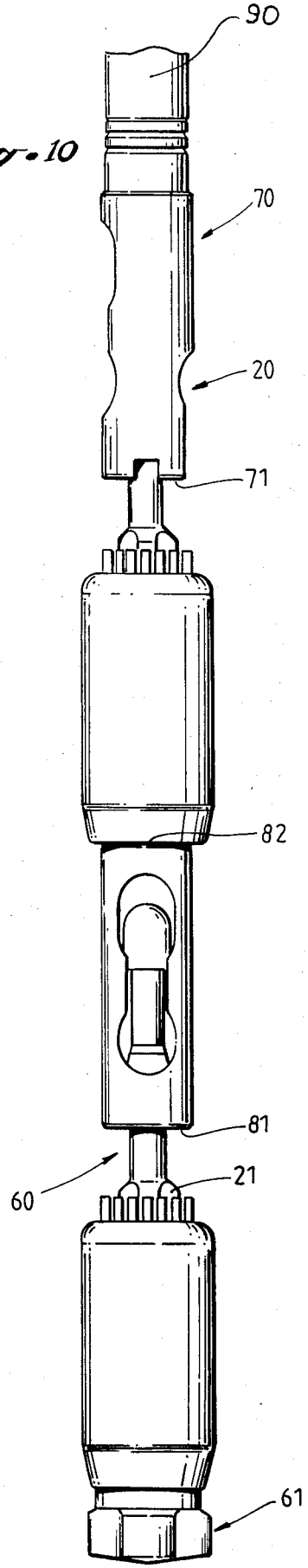
FIG. 10 is a view of the swab cup of this invention associated with a cooperating mandrel assembly when the swab cups are seated and under fluid pressure.

The swab cup 10 of the current disclosure is intended to be mounted on a mandrel assembly 20 (see FIGS. 7, 9 and 10) which includes fluid passageway flutes 21. During the downward travel of the swabbing assembly through the well fluid the swab cup 10 slides up along the mandrel 20 as illustrated in FIG. 7 until the uppermost planar surfaces 57 of reinforcing wires 50 contact the bottommost surface 71 of swivel joint mandrel section 70 or the bottommost surface 81 of mandrel center section 80 (see FIG. 9). This positioning allows well fluids to bypass the cup through flutes 21, and thereby permits the swab assembly to have a fast rate of fall. After the cup has reached a satisfactory depth in the well fluid, the ascent of the swab is begun. The swab cups 10 are then seated on the mandrel assembly 20 so that the bottommost surface of swab cup 10 is restrained by either noseguide 61 of bottom mandrel section 60 or shoulder 82 of mandrel center section 80 (see FIG. 10).

When the desired well depth has been attained and an upward force is applied to the swabbing assembly the downward load of fluid above the swab assembly causes the upper portion of the swab cup to distend radially outwardly into contact with the inner surface of the well pipe 30. The well fluid, thus contained, is then lifted upwardly as the swab assembly is raised in the pipe by the operator. A fluid tight seal between the bottom of swab cup 10 and shoulder 82 is accomplished by the downward force of the fluid and the friction between the outer surface of the swab cup elastomeric material 11 and the interior surface of well pipe 30.

The mandrel assembly 20 includes three component parts. A swivel joint mandrel piece 70 includes a threaded end 72 for attachment to a sinker bar or sucker rod 90 (see FIGS. 9 and 10) and a bottommost surface 71 to restrain the swab cup 10 during the downward or "running-in" movement of the mandrel assembly including swab cups. Swivel joint mandrel piece 70 includes an axial apperture 73 for receiving the uppermost end of either central mandrel section 80 or bottom mandrel section 60. The coupling of mandrel sections 60, 70 and 80 is well known in the art. The novel and unique configuration of reinforcing wires 50 in the reinforcement cage 40 of this invention provides the basis for proper alignment of swab cups with surfaces 71 or 81 during the descent of the sucker rod assembly. In typical swabbing operations a pair of swab cups are used in a mandrel assembly such as demonstrated by FIGS. 9 and 10. It is, however, possible to use a single swab cup 10 on either a mandrel assembly which includes swivel joint mandrel section 70 and center mandrel section 80 or more desirably a swabbing assembly with a single swab cup that includes mandrel sections 70 and 60 with integral noseguide 61. The various options for using the swab cup of this invention in cooperation with various mandrel assemblies are well known in the art.

Typically, more than one swab cup is used in a swabbing assembly and in the most common swabbing assembly two swab cups 10 are used in combination with mandrel sections 60, 70 and 80. Further and additional cup assemblies may be attached to the sinker rod or sucker rod by having them mounted on additional center sections 80. In this manner there may be incorporated in the line as many swab cups as may be desired. The particular number of swab cups used at one time and the mandrel assembly configuration are matters of choice by the operator of the swabbing rig.

Although the swab cups of this invention are not limited to any specific mandrel assembly, it is preferred to use the swab cups in conjunction with a mandrel assembly such as is shown and described in commonly assigned U.S. Pat. No. 3,399,605. As has been described hereinabove, for the typical two swab cup swabbing assembly it is necessary to use mandrel sections 60, 70 and 80 as shown and described in FIGS. 7, 9 and 10. If the operator desires more than two swab cups then additional center sections 80 are added. A substantial advantage of the mandrel assembly of U.S. Pat. No. 3,399,605 is the presence of two seating shoulders in each of the mandrel sections. The disclosure of U.S. Pat. No. 3,399,605 is hereby incorporated by reference.

The improved swab cup of this invention has demonstrated superior performance characteristics over prior art swab cups which are characterized by reinforcing wires which are angled inwardly at their uppermost ends. The reinforcing wires of the improved swab cup of this invention are superior because the planar junction of uppermost planar surfaces 57 of reinforcing wires 50 and surfaces 81 and 71 does not result in an outward force on the reinforcing wires 50. In prior art devices with reinforcing wires extending upward from the elastomeric body portion that are angled inwardly by crimping after the injection molding/bonding operation, the crimped portion has a tendency to return to its pre-crimping alignment which results in the swab cup being "hung-up" on the mandrel assembly.

Functionally, an operator secures a typical mandrel assembly, mounts one or more swab cups thereon and secures the complete assembly onto the sinker bar or sucker rod 90. Where more than one swab cup is to be employed additional mandrel center sections may be used.

Referring now to FIGS. 4, 5 and 6 the reinforcement cage assembly of this invention is illustrated. The reinforcement cage assembly 40 includes an outer ring member 41 and an inner ring member 42. The combination of ring members 41 and 42 comprise the base assembly 43. Ring members 41 and 42 have mated, concentric flanges 44 and 45, respectively which are used to retain and align the reinforcing wires. Reinforcing wires 50 are retained and aligned between inner and outer rings 41 and 42. The number, size and shape of reinforcing wires 50 may vary depending on the size of the swab cup being formed and the pressure and wear characteristics desired.

In the most preferred embodiment of the invention there are a plurality of reinforcing wires 50 which are divided into a first portion of reinforcing wires 51 and a second portion of reinforcing wires 55. A first portion of reinforcing wires 51 extend substantially the entire axial length of swab cup 10. In fact, the reinforcing wires 51 of the first portion define the axial length of swab cup 10. The reinforcing wires 51 of the first portion are contoured so as to have a first curvilinear section 52 at the bottommost end and a second curvilinear section 53 at the topmost end of each wire 51. The first curvilinear section 52 is contoured to be fittably received between inner and outer ring members 41 and 42. The second curvilinear section 53 is designed to arc inwardly and then upwardly as illustrated more specifically in FIG. 6 to prevent unnecessary frictional engagement with the well casing or piping during the upward travel of the swab cup. The contour of the reinforcing wires 51 of the first portion correspond precisely to the zones of maximum pressure resistance 13, flexible zone 14 and maximum flexibility zone 15 of swab cup 10.

A second portion of reinforcing wires 55 is also provided in this preferred embodiment of the swab cup 10 of this invention. The reinforcing wires 55 of the second portion extend from about 40% to 80% of the total axial length of the swab cup 10. In certain preferred embodiments the reinforcing wires 50 of second portion 55 are U-shaped such that both ends of the U-shaped wires are retained and aligned by ring members 41 and 42 but the upper end of wires 55 are U-shaped in configuration. This most preferred embodiment is illustrated by FIGS. 4, 5 and 6.

Figure 8:
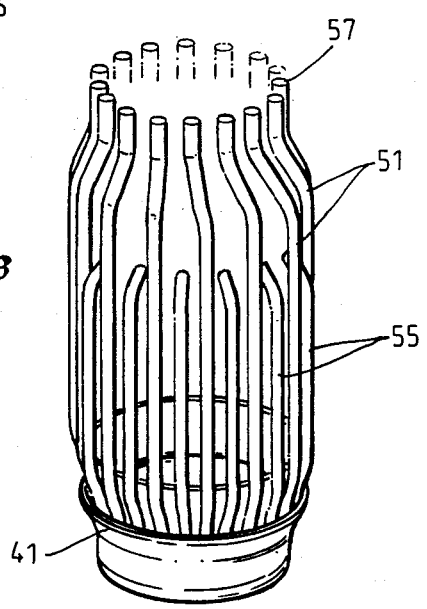
FIG. 8 is a perspective view of an alternate embodiment of the reinforcement cage according to the present invention.

Reinforcing wire members 55 can be contoured in a variety of configurations. The simplest and most direct configuration would be single wires engaged by the base assembly 43 and extending from 40% to 80% of the total axial length of the swab cup 10 as illustrated by FIG. 8. A more preferred embodiment would involve individual U-shaped reinforcing wires 55 wherein both free ends are retained and aligned by base assembly 43. An alternate embodiment would involve the joining of reinforcing wires 55 into a single wire member of the same configuration. The specific configuration and whether the reinforcing wires 55 are single wires, double wires in a U-shaped configuration, double wires in a continuous pattern, double wires in a configuration other than a U is not critical. The real significance of this combination is the unique capability of the swab cup employing such first and second portions of reinforcing wires to have maximum flexibility at the upper end 15, maximum pressure resistance at the lower end 13 and flexible reinforcement in the central portion 14. The reinforcing wires 55 of the second portion also have first curvilinear sections 56 which are contoured to be retained and aligned by base assembly 43.

In actual practice the reinforcement cage 40 is bonded to a resilient elastomeric material to form the finished swab cup 10. The elastomeric material is typically described as oil, gas and heat resistant. Typically, the elastomeric material is a blend of polymers. Some common polymers which are used in the blending operation are acrylonitrile, neoprene and a natural rubber blend. The specific compounding and polymers used are known in the industry.

It is essential in the manufacture of the swab cups of this inventions that the elastomeric material bond to the reinforcement cage 40. Merely molding the rubber around the cage will result in premature failure of the swab cup. After the reinforcement cage 40 has been assembled it must be prepared for molding. The preparation of reinforcement cage 40 involves steps of solvent degreasing and cleaning either by grit blast or by chemical means. Subsequently the reinforcement cage is again chemically decontaminated and dried. Prior to storage the reinforcement cage is painted with a primer coat and then painted with an adhesive coat. Both the primer and adhesive coating materials are available in the marketplace and are well known. The primer and adhesive coating materials enable the elastomeric material to bond to the reinforcement cage 40. The swab cup 10 is then prepared by conventional injection molding operations. Again, however, it is essential that the metal of the reinforcement cage 40 and the elastomeric material be bonded. Without an effective bond the swab cup will balloon upon the application of downhole pressure and will fail prematurely.

Although practice has shown that a variety of materials can be used to manufacture the reinforcement cage 40 the best results have been obtained when the base assembly 43 is made from alloy steel and the axially disposed reinforcing wire members 51 and 55 are made from spring steel.

During manufacture, the inner ring member 42 is embedded in the lower portion in the elastomeric body 11 just above its bottom, and the ring 42 extends well up into the body above the lower ends of the reinforcing wires. The lower portion of the base assembly 43 is of such a diameter as to lie very near the axial bore 16 of the swab cup 10 where it is covered with only a thin skin of elastomeric material. The central portion of the base assembly 43 curves outwardly and then joins an upper portion which lies much nearer to the outer periphery of the cup than to the axial bore 16. The central and upper portions of the inner base ring together are about as long as, or longer than, the lower portion thereof as measured parallel to the axis of the swab cup. The lower portion is expanded to confine the reinforcing wires against the outer ring and hold them in correct alignment with the axis of the finished swab cup.

The outer ring 41 of base assembly 43 is made of hardened metal and dimensionally stable so that it supports the reinforcing wires 50 against downward and outward displacement even under severe fluid pressure loading of the cup. The flange 46 extending inwardly from the bottom of the ring member 41 underlies the lower ends of all the wire members 50 and prevents their downward displacement. The flange 46 can also underly part of the lower periphery of the internal ring member 42 and help support it against downward displacement. In turn the flange 46 of outer ring member 41 seats upon the elastomeric bead located between the bottom of the flange 46 and the bottom of the swab cup 10 so that the outer ring member 41 derives vertical support as a result of the flange 46 being substantially seated upon the top surface of the mandrel shoulder 82 as shown in FIG. 7.

The outwardly extending concentric flange 44 which extends above the cylindrical portion of the outer ring curves outwardly more abruptly than the lower curvilinear section 52 of the reinforcement wires 50, with the result that flange 44 of the outer ring is normally out of contact with the wires until they are flexed. However, when the cup is heavily loaded and the wires 50 are flexed downwardly and outwardly by fluid pressure acting upon the elastomeric body 11 of the cup, the wires tend to lie upon and be supported by the adjacent surface of the outwardly extending flange 44. With reference to a method of manufacture of the swab cup of this invention attention is drawn to U.S. Pat. Nos. 3,724,337 and 3,724,338.

Although a typical embodiment of the present invention has been illustrated and discussed herein, numerous modifications and alternative embodiments of the apparatus and method of this invention will be apparent to those skilled in the art in view of this description. Accordingly, this description is to be construed as illustrative only and is provided for the purpose of teaching those skilled in the art the manner of constructing the device and performing the method of the invention. It is to be understood that the forms of the invention shown and described herein are to be considered as the presently preferred embodiments. Various changes may be made in the configurations, sizes and arrangements of the parts of the invention, as will be recognized by those skilled in the art, without departing from the scope of the invention. For example, equivalent elements might be substituted for those illustrated and described herein, parts or connections might be reversed or otherwise interchanged, and certain features of the invention might be utilized independently of the use of other features, all as will be apparent to one skilled in the art after receiving the benefit obtained through reading the foregoing description of the invention.

What is claimed is:

1. An improved reinforcement cage assembly for use in the manufacture of a load lifting swab cup, said swab cup including an elastomeric material bonded to said reinforcement cage assembly, said swab cup having an axial bore therethrough and being configured to be fittably received by a supporting mandrel, said reinforcement cage assembly comprising:

(a) a metal base assembly including inner and outer ring members;

(b) a plurality of axially disposed reinforcing wire members, at least one end of each of said wire members being retained between said inner and outer ring members;

(c) a first portion of said plurality of axially disposed reinforcing wire members extending for the entire axial length of said swab cup; and (d) a second portion of said plurality of axially disposed reinforcing wire members extending less than the entire axial length of said swab cup said second portion of said plurality of axially disposed reinforcing wire members comprising reinforcing wires configured such that both ends of each reinforcing wire of said second portion are retained between said inner and outer ring members of said base assembly.

2. The improved reinforcement cage assembly of claim 1 wherein each reinforcing wire member of said second portion of axially disposed reinforcing wire members is U-shaped in configuration and wherein the axial length of each of said U-shaped wire members is from 40% to 80% of the total axial length of said cage assembly.

3. An improved reinforcement cage assembly for use in the manufacture of a load-lifting swab cup, said swab cup including an elastomeric material bonded to said reinforcement cage assembly, said swab cup having an axial bore therethrough and being configured to be fittably received by a supporting mandrel, said reinforcement cage assembly comprising:

(a) a metal base assembly including inner and outer ring members, said inner and outer ring members including flanges contoured to retain and align a first curvilinear section of reinforcing wire members;

(b) a plurality of axially disposed reinforcing wire members, at least one end of each of said wire members being retained between said inner and outer ring members and contoured to be fittably received between the respective flanges of said inner and outer ring members;

(c) a first portion of said plurality of axially disposed reinforcing wire members extending for the entire axial length of said swab cup, each wire member of said first portion of said plurality of axially disposed reinforcing wire members including a first curvilinear section adapted to be retained by said base assembly and a flex zone for providing flexible reinforcement to said swab cup; and (d) a second portion of said plurality of axially disposed reinforcing wire members comprising reinforcing wires that are configured such that both ends of each reinforcing wire of said second portion are retained between said inner and outer ring members of said base assembly, and wherein each of said reinforcing wire members of said second portion includes a first curvilinear section adapted for retention by said base assembly and at least one flex zone for providing flexible reinforcement to said swab cup.

4. The improved reinforcement cage assembly of claim 3 wherein said metal base assembly, including said inner and outer ring members, is made from alloy steel.

5. The improved reinforcement cage assembly of claim 3 wherein said axially disposed reinforcing wire members are made from spring steel.

6. The improved reinforcement cage assembly of claim 3 wherein each reinforcing wire member of said second portion of axially disposed reinforcing wire members is U-shaped in configuration and wherein the axial length of each of said U-shaped wire members is from 40% to 80% of the total axial length of said cage assembly.

7. The improved reinforcement cage assembly of claim 3 wherein each of said reinforcing wire members of said first portion of axially disposed reinforcing wire members further includes a second curvilinear section, the combination of said second curvilinear sections of said first portion of said plurality of axially disposed reinforcing wire members defining the internal peripheral circumference of said axial bore.

8. An improved load-lifting swab cup having an axial bore wherein said swab cup is characterized by flexibility at its upper end and reinforcement to prevent slumping at its lower end, said swab cut comprising:

(a) a reinforcement cage assembly which includes:

(i) a metal base assembly including inner and outer ring members;

(ii) a plurality of axially disposed reinforcing wire members, at least one end of each of said wire members being retained between said inner and outer ring members;

(iii) a first portion of said plurality of axially disposed reinforcing wire members extending for the entire axial length of said swab cup; and (iv) a second portion of said plurality of axially disposed reinforcing wire members extending less than the entire axial length of said swab cup, said second portion of said plurality of axially disposed reinforcing wire members comprising reinforcing wires configured such that both ends of each reinforcing wire of said second portion are retained between said inner and outer ring members of said base assembly;

(b) an elastomeric material bonded to a portion of said reinforcement cage assembly; and (c) means incorporated into said swab cup for cooperatively receiving a supporting mandrel.

9. The improved load lifting swab cup of claim 8 wherein each reinforcing wire member of said second portion of axially disposed reinforcing wire members is U-shaped in configuration and wherein the axial length of each of said U-shaped wire members is from 40% to 80% of the total axial length of said cage assembly.

10. An improved load-lifting swab cup having an axial bore wherein said swab cup is characterized by flexibility at its upper end and reinforcement to prevent slumping at its lower end, said swab cup comprising:

(a) a reinforcement cage assembly which includes:

(i) a metal base assembly including inner and outer ring members, said inner and outer ring members including flanges contoured to retain and align a first curvilinear section of reinforcing wire members;

(ii) a plurality of axially disposed reinforcing wire members, at least one end of each of said wire members being retained between said inner and outer ring members and contoured to be fittably received between the respective flanges of said inner and outer ring members;

(iii) a first portion of said plurality of axially disposed reinforcing wire members extending for the entire axial length of said swab cup, each wire member of said first portion of said plurality of axially disposed reinforcing wire members including a first curvilinear section adapted to be retained by said base assembly and a flex zone for providing flexible reinforcement to said swab cup; and (iv) a second portion of said plurality of axially disposed reinforcing wire members comprising reinforcing wires that are configured such that both ends of each reinforcing wire of said second portion are retained between said inner and outer ring members of said base assembly, and wherein each of said reinforcing wire members of said second portion includes a first curvilinear section adapted for retention by said base assembly and at least one flex zone for providing flexible reinforcement to said swab cup;

(b) an elastomeric material bonded to a substantial portion of said reinforcement cage assembly; and (c) means incorporated into said swab cup for cooperatively receiving a supporting mandrel.

11. The improved load-lifting swab cup of claim 10 wherein said metal base assembly, including said inner and outer ring members, is made from alloy steel.

12. The improved load-lifting swab cup of claim 10 wherein said axially disposed reinforcing wire members are made from spring steel.

13. The improved load-lifting swab cup of claim 10 wherein each reinforcing wire member of said second portion of axially disposed reinforcing wire members is U-shaped in configuration and wherein the axial length of each of said U-shaped wire members is from 40% to 80% of the total axial length of said cage assembly.

14. The improved load-lifting swab cup of claim 10 wherein each of said reinforcing wire members of said first portion of axially disposed reinforcing wire members further includes a second curvilinear section, the combination of said second curvilinear sections of said first portion of said plurality of axially disposed reinforcing wire members defining the internal peripheral circumference of said axial bore.

* * * * *